US006189456B1

(12) United States Patent
Smith et al.

(10) Patent No.: US 6,189,456 B1
(45) Date of Patent: Feb. 20, 2001

(54) HIGH CAPACITY AXLE FOR RAILWAY FREIGHT CARS

(75) Inventors: Stephen W. Smith, Dallas; John W. Coulborn, Fort Worth, both of TX (US)

(73) Assignee: TRN Business Trust, Dallas, TX (US)

( * ) Notice: Under 35 U.S.C. 154(b), the term of this patent shall be extended for 0 days.

(21) Appl. No.: 09/167,402

(22) Filed: Oct. 6, 1998

Related U.S. Application Data

(60) Provisional application No. 60/061,543, filed on Oct. 7, 1997.

(51) Int. Cl.[7] ..... B61F 15/00

(52) U.S. Cl. ..... 105/218.1; 105/182.1; 295/36.1; 384/459

(58) Field of Search ..... 105/182.1, 218.1; 295/36.1; 73/146; 384/459; 364/474.24; 716/19

(56) References Cited

U.S. PATENT DOCUMENTS

| | | | | |
|---|---|---|---|---|
| 2,512,186 | * | 6/1950 | Urschel | 295/36.1 |
| 2,597,516 | * | 5/1952 | Noe | 384/459 |
| 2,676,073 | * | 4/1954 | Boden | 384/459 |
| 2,747,918 | * | 5/1956 | Blackwood | 295/36.1 |
| 2,878,083 | * | 3/1959 | Altson | 384/459 |
| 2,891,827 | * | 6/1959 | Butkus | 384/459 |
| 2,901,299 | * | 8/1959 | Cramer et al. | 384/459 |
| 2,977,138 | * | 3/1961 | Brittain, Jr. | 384/459 |
| 3,718,040 | * | 2/1973 | Freeman et al. | 73/146 |
| 3,802,352 | * | 4/1974 | Keller | 295/36.1 |
| 3,869,180 | * | 3/1975 | Sonnerat | 384/459 |
| 5,017,025 | | 5/1991 | Williams | 384/584 |
| 5,462,367 | * | 10/1995 | Davidson et al. | 384/459 |
| 5,524,552 | | 6/1996 | Weber | 105/199.5 |
| 5,684,713 | * | 11/1997 | Asada et al. | 364/474.24 |

OTHER PUBLICATIONS

"Finite Element Structural Analysis", T. Y. Yang, 1986, Chp. 1.*

"Aircraft Structures, Second Edition", David J. Peery & J. J. Azar, 1982, Chp. 7.*

"The Car and Locomotive Cyclopedia of American Practices," Sixth Edition, *1997 Car & Locomotive Cyclopedia,* Simmons–Boardman Books, Inc., pp. 796–810, 1997.

* cited by examiner

*Primary Examiner*—S. Joseph Morano
*Assistant Examiner*—Lars A. Olson
(74) *Attorney, Agent, or Firm*—Baker Botts L.L.P.

(57) ABSTRACT

An improved railway car axle having a shaft body with a pair of wheel seats and a pair of journals respectively disposed adjacent to opposite ends of the axle. A dust guard seat may be located between each wheel seat and the associated journal. Also, fillets are preferably provided at transitions between the dust guard seat and the wheel seat and the dust guard seat and the journal respectively. The journals will preferably be generally cylindrical and may have a nominal outside diameter of approximately six and one half inches and a nominal length of approximately eight and three fourth inches. The dust guard seats separating the respective journals and wheel seats may have a length of approximately three and one half inches. Finally, the wheel seats preferably have a nominal outside diameter of nine and one fourth inches.

9 Claims, 3 Drawing Sheets

FIG. 3
(PRIOR ART)
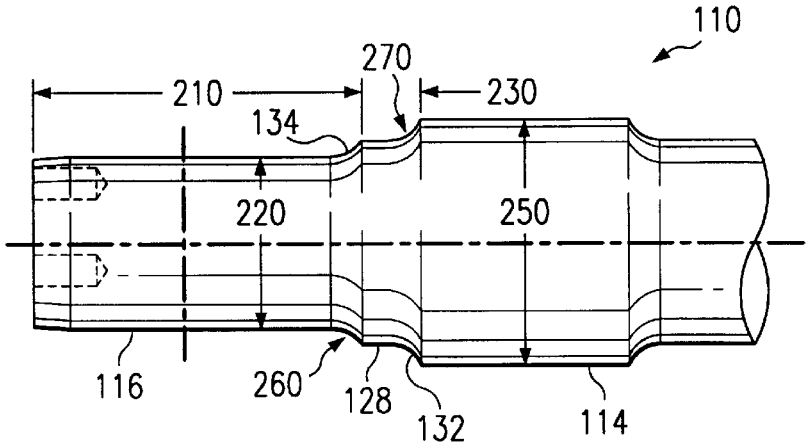
FIG. 4
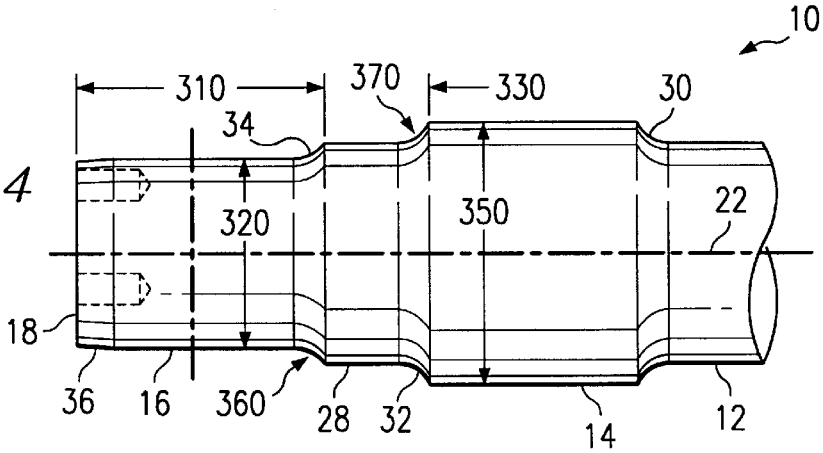
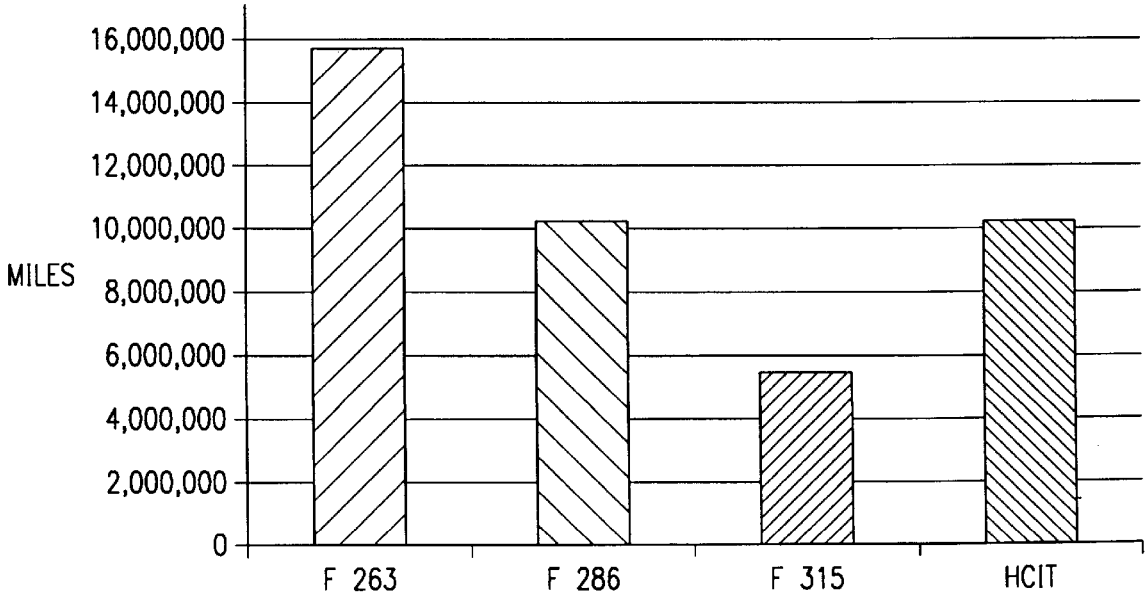
FIG. 6

HIGH CAPACITY AXLE FOR RAILWAY FREIGHT CARS

RELATED APPLICATIONS

This application claims the benefit of U.S. Provisional Application Ser. No. 60/061,543, filed Oct. 7, 1997.

TECHNICAL FIELD OF THE INVENTION

The present invention relates generally to railway car axles and more particularly to a high capacity axle capable of withstanding greater loading capacities while maintaining a longer life span.

BACKGROUND OF THE INVENTION

Most modern railway cars include a pair of railway trucks with each railway truck having a pair of axles. Typically, a pair of wheels are secured to each axle with the wheels spaced from each other at a distance corresponding with the gauge of the railway trucks. A pair of roller bearing assemblies are generally mounted on the axle to reduce friction and to allow the axle and associated wheels to rotate with a minimum amount of applied force. A railway axle typically includes a shaft with a wheel seat and journal formed adjacent to opposite ends of the shaft. A wheel is secured to each wheel seat. An associated journal extends from each wheel seat for mounting a respective bearing assembly adjacent to each end of the railway axle. Each bearing assembly is preferably tightly fitted on its respective journal. Each bearing assembly includes a housing that receives a portion of a frame for an associated railway truck. The journals often have the smallest diameter of the railway axle and the wheel seats often have the largest diameter. Therefore, a railway car axle will often flex between the journals and respective wheel seats when the associated railway car is loaded. Movement or flexing of the axle between the bearing assembly and the associated wheel will ultimately result in fretting and failure of the axle.

In order to make the railroad industry more competitive with other modes of transportation various methods have been undertaken to reduce fretting and increase the fatigue life of axles for railway cars. Efforts include hardcoating the journal with a wear resistant metal or alloy, and modifying the bearing assembly connection and accompanying seals. Prior modifications have substantially increased the cost of the axle and bearing assembly or the installation of both.

Other efforts have included railway car axle modifications such as varying the size of the journals and wheel seats. Allowable modifications are limited due to standard American Association of Railroads (AAR) classifications which require interchangeability of component parts.

SUMMARY OF THE INVENTION

Accordingly, a need has arisen in the art for an improved axle for railway cars. The present invention provides an axle for use with a pair of railway car wheels and a pair of roller bearing assemblies that substantially eliminates or reduces problems associated with the prior railway car axles when subjected to heavy loads.

In accordance with teachings of the present invention, an axle for a railway car may comprise a shaft body with a wheel seat and associated journal disposed adjacent to opposite ends of the axle. A dust guard seat may be formed on the axle between each wheel seat and the associated journal. Each journal will preferably be generally cylindrical and may have a diameter of approximately six and one half inches (6.5") and an approximate length of eight and three fourths inches (8.75"). Each dust guard seat, disposed between each journal from the respective wheel seat, may have a length of approximately three and one half inches (3.50") and a diameter of approximately seven and one half inches (7.5"). Finally, each wheel seat may preferably have a diameter of approximately nine and one fourth inches (9.25").

More specifically, in accordance with one embodiment of the present invention, a railway car axle may have fillets formed between each journal and the associated dust guard seat. Also, the railway car axle may have fillets formed between each dust guard seat and the associated wheel seat. In one embodiment, both of these fillets preferably have a radius equal to approximately one and one-half inches (1.5").

Technical advantages of the present invention include providing a railway car axle which can support heavier loads than current railway car axles with approximately the same dimensions while maintaining an extended fatigue life. In particular, a journal is provided at each end of a railway car axle with an increased outside diameter and a reduced length which cooperate with each other to reduce deflection of the railway car axle and minimize fretting between the axle and components carried on the axle. At an applied vertical load of approximately 315,000 pounds per railway car, a railway car axle incorporating teachings of the present invention may demonstrate a fatigue life approximately equal to an AAR standard "Class F" axle under a vertical load of approximately 286,000 pounds per railway car with a only a slight increase in axle weight as compared to the "Class F" axle. Furthermore, the railway car axle may include wheel seats having a length typical of the AAR standard "Class F" axle, and be suitable for the installation of a thirty-six inch (36") diameter wheel while maintaining the capability of supporting a load of 315,000 pounds per railway car. A wheel seat incorporating teachings of the present invention preferably has an enlarged outside diameter of approximately nine and one fourth inches (9.25") to prevent installation of wheels that are not designed for supporting heavy loads.

Still another technical advantage of the present invention includes decreased maintenance costs associated with replacement of failed railway car axles.

BRIEF DESCRIPTION OF THE DRAWINGS

For a more complete understanding of the present invention, and the advantages thereof, reference is now made to the following brief description, taken in conjunction with the accompanying drawings and detailed description, wherein like reference numerals represent like parts, in which:

FIG. 3 is a schematic drawing in elevation with portions broken away of a typical AAR "Class F" railway car axle;

FIG. 4 is a schematic drawing in elevation with portions broken away of a railway car axle incorporating features of one embodiment of the present invention;

FIG. 6 is a graphic representation of estimated axle fatigue life for various railway car axles under different loading conditions.

DETAILED DESCRIPTION OF THE INVENTION

Preferred embodiments of the present invention and its advantages are best understood by referring now in more detail to FIGS. 1–6 of the drawings, in which like numerals refer to like parts.

Figure 1:
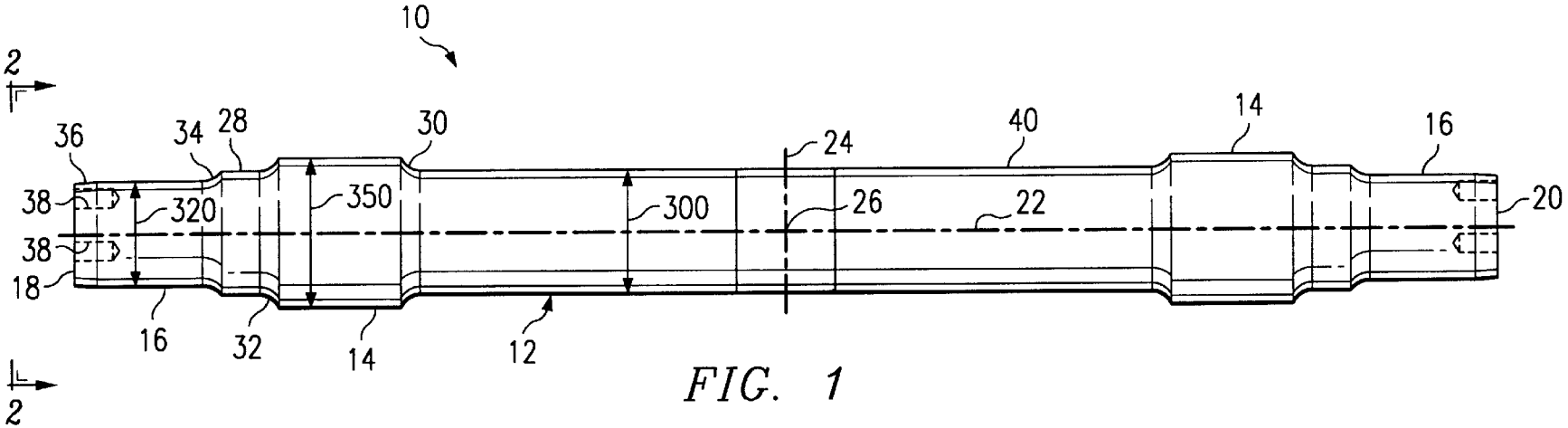
FIG. 1 is a schematic drawing in elevation showing a railway car axle incorporating features of the present invention.
Figure 2:
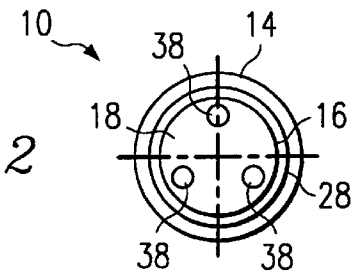
FIG. 2 is an end view of the railway car axle shown in FIG. 1.

As shown in FIG. 1, a railway car axle 10 includes a shaft body 12, a pair of wheel seats 14 and associated journals 16 formed adjacent to opposite ends 18 and 20 of railway car axle 10. Shaft body 12, wheel seats 14 and journals 16 are essentially cylindrical and concentric about a longitudinal axis 22. A radial axis 24 intersects shaft body 12 at a midpoint 26 and extends perpendicular to longitudinal axis 22. Railway car axle 10 is generally symmetric about longitudinal axis 22 and radial axis 24.

Shaft body 12, which extends between wheel seats 14, may sometimes be referred to as a barrel 40. For some applications, barrel 40 may have a relatively uniform outside diameter 300. For other applications, barrel 40 may have a slightly tapered outside diameter with the largest diameter 300 adjacent to wheel seats 14 and the smallest diameter 300 at midpoint 26.

Wheel seats 14 are preferably formed with a diameter 350 which is larger than barrel diameter 300. Journals 16 are preferably formed adjacent to ends 18 and 20 of railway car axle 10 and preferably have a diameter 320 which is less than wheel seat diameter 350. For some applications, a dust guard seat 28 is preferably formed between each wheel seat 14 and the associated journal 16. Wheel seat 14, journal 16, and dust guard seat 28 at end 18 of railway car axle 10 are discussed in further detail below in conjunction with FIG. 4.

One or more fillets are preferably formed on the exterior of railway car axle 10 between adjacent sections of railway car axle 10 having different outside diameters. These fillets are formed in order to minimize any stresses caused by the changes in the outside diameter of railway axle 10. Fillet 30 serves as a transition between diameter 300 of shaft body 12 and diameter 350 of wheel seat 14. Similarly, fillet 32 serves as a transition between dust guard seat 28 and associated wheel seat 14. Finally, fillet 34 serves as a transition between dust guard seat 28 and journal 16. In one embodiment of the present invention, the radii of fillets 32 and 34 are both one and one half inches (1.5"), and the radius of fillet 30 is three inches (3.0").

Journal 16 preferably includes tapered collar 36 which terminates at end 18. For the embodiment shown in FIGS. 1 and 2, three threaded bolt holes 38 are formed in end 18 for use in securing a roller bearing assembly (not expressly shown) on journal 16. Examples of bearing assemblies are shown in U.S. Pat. No. 5,017,025 entitled Bearing Assembly for a Shaft Journal and U.S. Pat. No. 5,462,367 entitled Compact Bearing and Stiffened Journal. A relatively short roller bearing assembly such as shown in U.S. Pat. No. 5,462,367 may be particularly beneficial for use with the present invention.

FIG. 3 represents a partial schematic drawing in elevation of an AAR standard "Class F" railway car axle 110. FIG. 4 shows a portion of railway car axle 10 having various features of one embodiment of the present invention. AAR standard "Class F" railway car axle 110 includes wheel seat 114 and journal 116. Journal 116 has a nominal length 210 of eleven and three fourths inches (11.75"). In one embodiment of the present invention shown in FIG. 4, the length 310 of journal 16 for railway car axle 10 has been reduced to approximately eight and three fourths inches (8.75"). Reducing the length of journal 16 substantially reduces the moment arm associate with any forces applied to a bearing assembly mounted on journal 16. The diameter 220 of journal 116 for AAR standard "Class F" railway car axle 110 is approximately six and two tenths inches (6.2"). In one embodiment of the present invention shown in FIG. 4, diameter 320 of journal 16 has been increased to approximately six and one half inches (6.5").

In AAR standard "Class F" railway car axle 110, wheel seat 114 has a nominal diameter 250 of approximately eight and three fourths inches (8.75"). In one embodiment of the present invention shown in FIG. 4, diameter 350 of wheel seat 14 of railway car axle 10 has been increased to approximately nine and one fourth inches (9.25"). As a result of increasing diameter 350 of wheel seat 14 to approximately nine and one fourth inches (9.25"), only wheels which are designed for heavy loads may be mounted on railway car axle 10. Thus, enlarged diameter 350 prevents installing standard thirty six inch (36") wheels that may fail under the heavy load on railway car axle 10.

The length 330 of dust guard seat 28 has also been increased to three and one half inches (3.5") as compared to a length 230 of approximately one and eight tenths inches (1.8") of dust guard seat 128 associated with AAR standard "Class F" railway car axle 110. One of the benefits derived from increasing the length of dust guard seat 28 is maintaining the same longitudinal distance or spacing between the radial centerlines associated with journals 16 and the radial centerlines associated with wheel seats 14. Maintaining longitudinal spacing allows railway car axle 10 to be used with railway truck components that are geometrically the same as standard railway truck components. Often, only minor modifications need to be made to such components.

In one embodiment of the present invention shown in FIG. 4, the radii 370 and 360 of fillets 32 and 34, respectively, are both one and one half inches (1.5"). In this embodiment, radii 370 and 360 of fillets 32 and 34 are equal to the radii 270 and 260 of fillets 132 and 134 of AAR standard "Class F" railway car axle 110, which are also one and one half inches (1.5"). In addition, in one embodiment of the present invention, the outside diameter of dust guard seat 28 is equal to the outside diameter of dust guard seat 128 of AAR standard "Class F" railway car axle 110, both diameters being approximately seven and one half inches (7.5").

Figure 5:
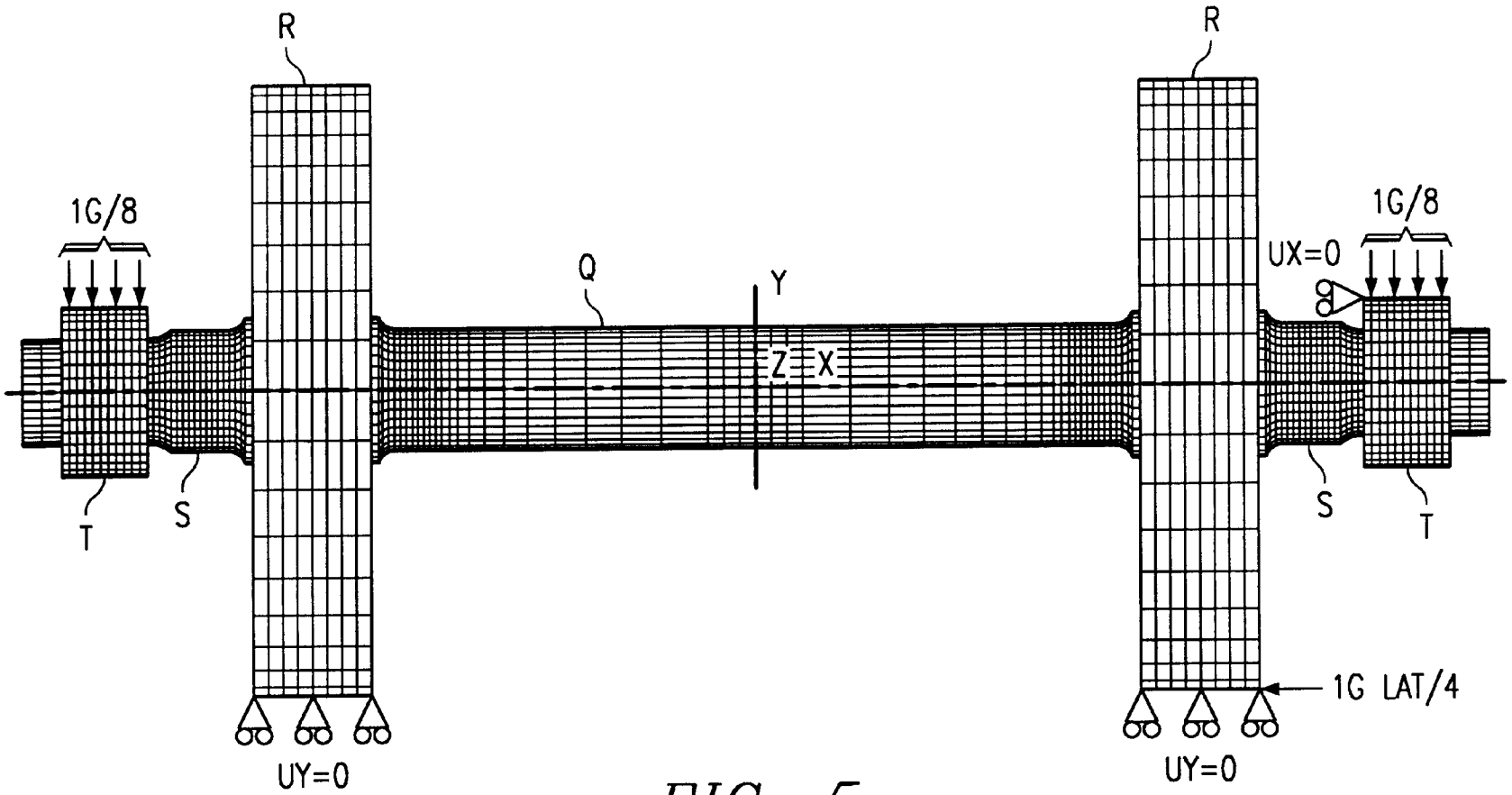
FIG. 5 represents a finite element model of a railway car axle with a pair of wheels and a pair of roller bearing assemblies mounted thereon which may be used to evaluate stresses and to conduct a fatigue analysis of various axle, wheel and bearing assembly configurations.

FIG. 5 represents the finite element model which was used to determine stresses present throughout a railway car axle incorporating the present invention, including shaft body Q, railway car wheels R, dust guard seats S, and bearing assemblies T. A similar model was used to determine the stresses in an AAR standard "Class F" railway car axle. Two types of loads were applied to the axles during the finite element analyses. The first type of load was a vertical load applied at each bearing T. This vertical load represents the weight of the railway car and any load that it is carrying. The mass of the vertical load is distributed over the length of each bearing T. The vertical load is indicated at each bearing T by "1G/8." This indicates that one-eighth (⅛) of the unit vertical load is applied at each bearing of the railway car. The load is divided by eight because there are four axles per railway car, and thus eight bearings per railway car.

The second type of load was a lateral load applied at the portion of wheel R that comes in contact with the rail (not explicitly shown). This lateral load represents the forces applied to the wheel by the rail, such as when the railway car is traveling around a curve. The lateral load is indicated at each wheel R by "1G LAT/4." This indicates that one-fourth (¼) of the unit lateral load is applied at each wheel on one side of the railway car. The load is divided by four because there are four axles per railway car, and thus eight wheels per railway car. However, only the wheels on one side of the railway car are subject to this load. The lateral load imparts a sheering force and a moment to the railway car axle Q. The lateral load applied to each axle is a function of the applied vertical load. As discussed below, a different vertical load was applied to each railway car axle, therefore, the lateral load applied in each case was also different.

The present invention was developed using an iterative process. First, the stress profile and estimated fatigue life of an AAR standard "Class F" railway car axle with a 35,750 pound vertical load distributed across each bearing T were calculated. This loading corresponds to a total vertical loading on a railway car of 286,000 pounds. The stress profile was determined using a finite element analysis of the model described above. The fatigue life was then calculated using the analysis set forth in the AAR Manual of Standards and Recommended Practices Section C, Part 2, Chapter 7. One goal in developing the present invention was to develop a railway car axle that could support a vertical load of 39,375 pounds distributed across each bearing T, but yet have approximately the same fatigue life as a "Class F" axle loaded with 35,750 pounds distributed over each bearing T. Thus, four of these newly developed axles on a railway car would support a vertical load of 315,000 pounds per railway car, as compared to the 286,000 pound load supported by four "Class F" axles.

To achieve this goal the following iterative process was followed. First, a set of dimensions of a railway car axle were chosen. Relevant dimensions included the journal diameter and length and the wheel seat diameter. Other dimensions were also varied as needed. These dimensions were initially chosen based on educated estimations as to how the chosen dimensions would effect such parameters as the strength, weight, and cost of the axle. Second, the stress profile of the axle incorporating the chosen dimensions with a vertical load of 39,375 pounds distributed across each bearing T was determined using a finite element analysis as described above. Third, the estimated fatigue life of the axle was calculated from the results of this finite element analysis as described above. Finally, the estimated fatigue life of the axle was compared with the estimated fatigue life of the AAR standard "Class F" railway car axle with a vertical load of 35,750 pounds distributed across each bearing T.

This process was repeated until an axle was developed that had a estimated fatigue life, when subject to vertical load of 39,375 pounds distributed across each bearing T, that approximately equaled the estimated fatigue life of the AAR standard "Class F" railway car axle with a vertical load of 35,750 pounds distributed across each bearing T. In this manner, the present invention was developed. It should be noted that the calculated fatigue lives of both the AAR standard "Class F" railway car axle and the axle incorporating the present invention are not absolute. Some assumptions were made in order to make these calculations. However, the same assumptions were applied to both axles, so the calculated fatigue lives of both axles can be accurately compared.

FIG. 6 is a graphic representation of the estimated fatigue life of an AAR standard "Class F" railway car axle under different loading conditions and a railway car axle incorporating the teachings of the present invention under a vertical railway car load of 315,000 pounds (or a vertical load of 39,375 pounds distributed across each bearing of the axle). The graphs are the result of fatigue analysis conducted on the basis of a finite element model, such as shown in FIG. 5, and spectra of load level reversals derived from testing performed by the American Association of Railroads at the Transportation Technology Center. The vertical axis represents the estimated fatigue life, in miles, for corresponding railway car axle designs and loading conditions.

F263 represents an AAR standard "Class F" railway car axle under a vertical railway car load of 263,000 pounds (or a vertical load of 32,875 pounds distributed across each bearing of the axle). Similarly, F286 corresponds to an AAR standard "Class F" railway car axle subject to a vertical railway car load of 286,000 pounds (or a vertical load of 35,750 pounds distributed across each bearing of the axle). Accordingly, F315 describes an AAR standard "Class F" railway car axle exposed to a vertical railway car load of 315,000 pounds (or a vertical load of 39,375 pounds distributed across each bearing of the axle). Increasing the load significantly reduces the fatigue life of the AAR standard "Class F" railway car axle. The bar directly above the letters "HCIT", represents the estimated performance of railway car axle 10, incorporating teachings of the present invention, when exposed to a vertical railway car load of 315,000 pounds (or a vertical load of 39,375 pounds distributed across each bearing of the axle).

Except for the previously discussed changes in the outside diameter 350 of wheel seats 14, the length of dust guard seats 28, and the length and outside diameter 320 of journals 16, railway car axle 10, as depicted in FIG. 4, includes essentially the same dimensions as an AAR standard "Class F" railway car axle. These changes result in a dramatic increase in the fatigue life of railway car axle 10 when subjected to a vertical load of 315,000 pounds per railway car as compared to an AAR standard "Class F" railway car axle subjected to a similar 315,000 pound vertical load per railway car.

The dramatic increase in fatigue life of railway car axle 10 as shown in FIG. 6, results from incorporating the teachings of the present invention. The weight of railway car axle 10, incorporating the dimensions shown in FIG. 4, is only slightly heavier then the AAR standard "Class F" railway car axle 110. In addition, as can be seen from FIG. 6, the fatigue life of the "HCIT" axle with a 315,000 pound vertical load per railway car approximately equals the fatigue life of the AAR standard "Class F" railway car axle with a vertical load of 286,000 pounds per railway car. Thus the above described goal of the present invention has been achieved.

Although the present invention has been described in detail, it should be understood that various changes, substitutions, and alterations can be made hereto without departing from the spirit and scope of the invention as defined by the appended claims.

What is claimed is:

1. A railway car axle comprising:

a first journal and a second journal for respectively mounting a first bearing assembly and a second bearing assembly on the railway car axle;

the first journal formed proximate a first end of the railway car axle and the second journal formed proximate a second end of the railway car axle;

a first wheel seat and a second wheel seat for respectively securing a pair of railway car wheels on the railway car axle;

the first wheel seat formed proximate to the first journal and the second wheel seat formed proximate the second journal;

a generally cylindrical, elongated shaft body formed between the first and second wheel seats;

a first dust guard seat formed between the first wheel seat and the first journal;

a second dust guard seat formed between the second wheel seat and the second journal;

the first and second journals each having a nominal outside diameter of approximately six and one half inches; and the first and second journals each having a nominal length of approximately eight and three fourths inches.

2. A railway car axle comprising:

a first journal and a second journal for respectively mounting a first bearing assembly and a second bearing assembly on the railway car axle;

the first journal formed proximate a first end of the railway car axle and the second journal formed proximate a second end of the railway car axle;

a first wheel seat and a second wheel seat for respectively securing a pair of railway car wheels on the railway car axle;

the first wheel seat formed proximate to the first journal and the second wheel seat formed proximate the second journal;

a generally cylindrical, elongated shaft body formed between the first and second wheel seats;

a first dust guard seat formed between the first wheel seat and the first journal;

a second dust guard seat formed between the second wheel seat and the second journal; and the first and second journals each having a nominal outside diameter of approximately six and one half inches; and the first and second dust guard seats each having a length of approximately three and one half inches.

3. A railway car axle comprising:

a first journal and a second journal for respectively mounting a first bearing assembly and a second bearing assembly on the railway car axle;

the first journal formed proximate a first end of the railway car axle and the second journal formed proximate a second end of the railway car axle;

a first wheel seat and a second wheel seat for respectively securing a pair of railway car wheels on the railway car axle;

the first wheel seat formed proximate to the first journal and the second wheel seat formed proximate the second journal;

a generally cylindrical, elongated shaft body formed between the first and second wheel seats;

a first dust guard seat formed between the first wheel seat and the first journal;

a second dust guard seat formed between the second wheel seat and the second journal;

the first and second journals each having a nominal outside diameter of approximately six and one half inches: and the first and second dust guard seats each having a diameter of approximately seven and one half inches.

4. A railway car axle comprising:

a first journal and a second journal for respectively mounting a first bearing assembly and a second bearing assembly on the railway car axle;

the first journal formed proximate a first end of the railway car axle and the second journal formed proximate a second end of the railway car axle;

a first wheel seat and a second wheel seat for respectively securing a pair of railway car wheels on the railway car axle;

the first wheel seat formed proximate to the first journal and the second wheel seat formed proximate the second journal;

a generally cylindrical, elongated shaft body formed between the first and second wheel seats;

a first dust guard seat formed between the first wheel seat and the first journal;

a second dust guard seat formed between the second wheel seat and the second journal;

the first and second journals each having a nominal outside diameter of approximately six and one half inches; and the first and second wheel seats each having a diameter larger than the nominal diameter of an AAR standard "Class F" railway car axle whereby only railway car wheels designed for heavy loads may be mounted on the railway car axle.

5. A railway car axle comprising:

a first journal and a second journal for respectively mounting a first bearing assembly and a second bearing assembly on the railway car axle;

the first journal formed proximate a first end of the railway car axle and the second journal formed proximate a second end of the railway car axle;

a first wheel seat and a second wheel seat for respectively securing a pair of railway car wheels on the railway car axle;

the first wheel seat formed proximate to the first journal and the second wheel seat formed proximate the second journal;

a generally cylindrical, elongated shaft body formed between the first and second wheel seats;

a first dust guard seat formed between the first wheel seat and the first journal;

a second dust guard seat formed between the second wheel seat and the second journal;

the first and second journals each having a nominal outside diameter of approximately six and one half inches; and the first and second wheel seats each having a nominal diameter of approximately nine and one fourth inches.

6. The railway car axle of claim 2 further comprising the first and second dust guard seats and the first and second journals being respectively connected at a fillet having a radius of one and one half inches.

7. The railway car axle of claim 2 further comprising the first and second dust guard seats and the first and second wheel seats being respectively connected at a fillet having a radius of one and one half inches.

8. A railway car axle comprising:

a pair of generally cylindrical journals for the mounting of a respective roller bearing assembly on each journal;

one journal located proximate a first end of the railway car axle and the second journal located proximate a second end of the railway car axle;

a pair of generally cylindrical wheel seats for relatively securing a pair of railway car wheels on the railway car axle;

each wheel seat located proximate a respective journal;

a dust guard seat located between each wheel seat and the associated journal;

a generally cylindrical, elongated shaft body located between the wheel seats;

each journal having a nominal diameter equal to six and one half inches and a nominal length equal to eight and three fourths inches;

each wheel seat having a nominal diameter of approximately nine and one fourth inches; and each dust guard seat having a nominal length of three and one half inches.

9. A railway car axle comprising:

a pair of generally cylindrical journals for the mounting of a respective roller bearing assembly on each journal;

one journal located proximate a first end of the railway car axle and the second journal located proximate a second end of the railway car axle;

a pair of generally cylindrical wheel seats for relatively securing a pair of railway car wheels on the railway car axle;

each wheel seat located proximate a respective journal;

a dust guard seat located between each wheel seat and the associated journal;

a generally cylindrical, elongated shaft body located between the wheel seats;

each wheel seat having a diameter of approximately nine and one fourth inches;

each journal having a nominal diameter of approximately six and one half inches and a nominal length of eight and three fourths inches;

each dust guard seat having a length of approximately three and one half inches;

each dust guard seat and the associated journal being connected at a fillet;

the fillets connecting the dust guard seats and the respective journals having a radius equal to approximately one and one half inches;

each dust guard seat and the associated wheel seat being connected at a fillet; and the fillets connecting the dust guard seats and the respective wheel seats having a radius equal to approximately one and one half inches.

* * * * *